United States Patent [19]

Gilbert

[11] Patent Number: 5,007,110

[45] Date of Patent: Apr. 16, 1991

[54] FOCUS VISION VISOR

[76] Inventor: Charles A. Gilbert, P.O. Box 979, USSAH, Washington, D.C. 20317

[21] Appl. No.: 551,343

[22] Filed: Jul. 12, 1990

[51] Int. Cl.[5] ..... A42B 1/06

[52] U.S. Cl. ..... 2/10; 2/171; 2/172; 2/185 R; 2/199; 2/200

[58] Field of Search ..... 2/10, 13, 15, 171, 172, 2/173, 185 R, 199, 200

[56] References Cited

U.S. PATENT DOCUMENTS

| | | | |
|---|---|---|---|
| 1,008,109 | 11/1911 | Bickerton | 2/185 R |
| 1,665,750 | 4/1928 | McKee et al. | 2/200 X |
| 1,781,832 | 11/1930 | Crenshaw | 2/10 |
| 2,717,385 | 9/1955 | Linster | 2/10 |
| 2,769,308 | 11/1956 | Krasno | 2/200 X |
| 2,787,791 | 4/1957 | Linney et al. | 2/200 X |
| 3,330,051 | 7/1967 | Pambello | 35/12 |
| 4,179,753 | 12/1979 | Aronberg et al. | 2/DIG. 11 X |
| 4,277,847 | 7/1981 | Florio | 2/199 X |
| 4,321,708 | 3/1982 | Troiano | 2/199 X |
| 4,335,471 | 6/1982 | Quigley, Jr. et al. | 2/200 X |
| 4,630,317 | 12/1986 | Brown et al. | 2/12 |
| 4,839,924 | 1/1989 | Laurence | 2/10 |

FOREIGN PATENT DOCUMENTS

| | | | |
|---|---|---|---|
| 819410 | 9/1959 | United Kingdom | 2/10 |
| 1477818 | 6/1977 | United Kingdom | 2/199 |

*Primary Examiner*—Werner H. Schroeder
*Assistant Examiner*—Jeanette E. Chapman
*Attorney, Agent, or Firm*—David H. Semmes

[57] ABSTRACT

Visors, for a cap or headpiece. Particularly, a focus vision visor in the form of one or more blinders which depend vertically from the visor, so as to limit peripheral vision. The blinders in the non-use storage mode may be secured to the underside of the visor.

3 Claims, 3 Drawing Sheets

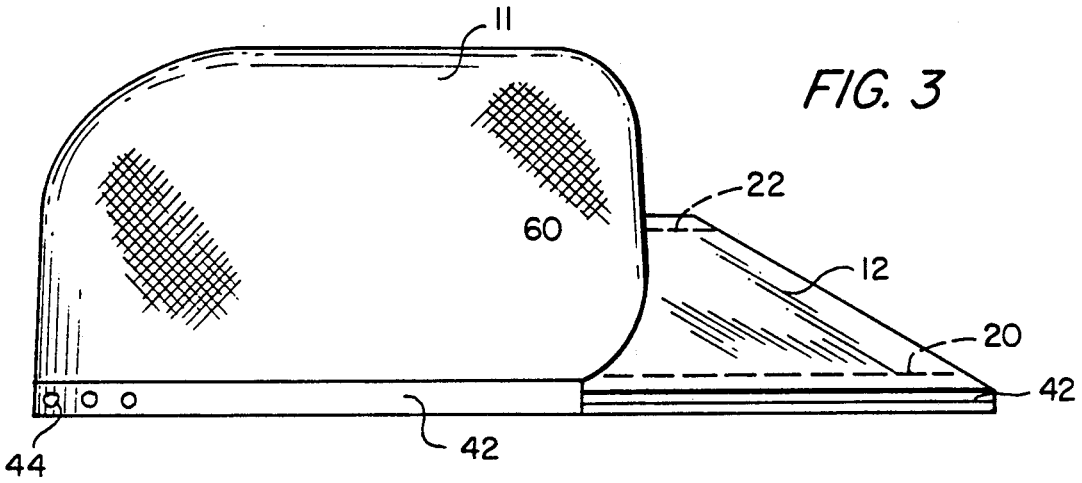
FIG. 3
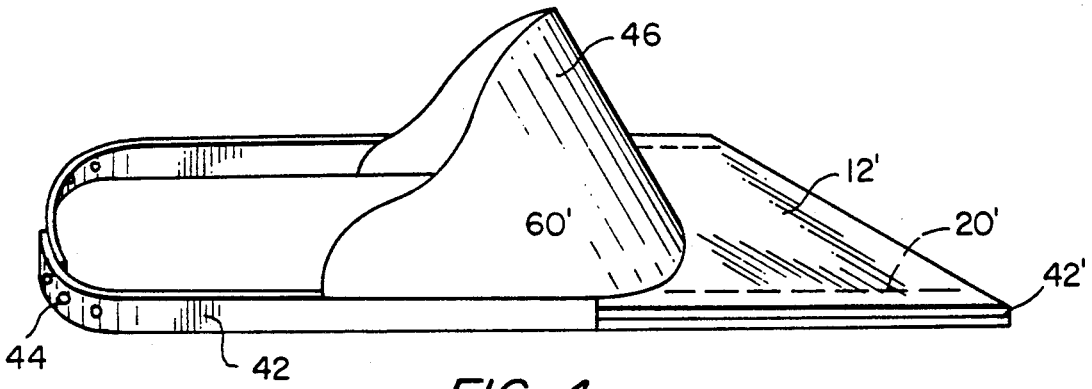
FIG. 4
FIG. 5
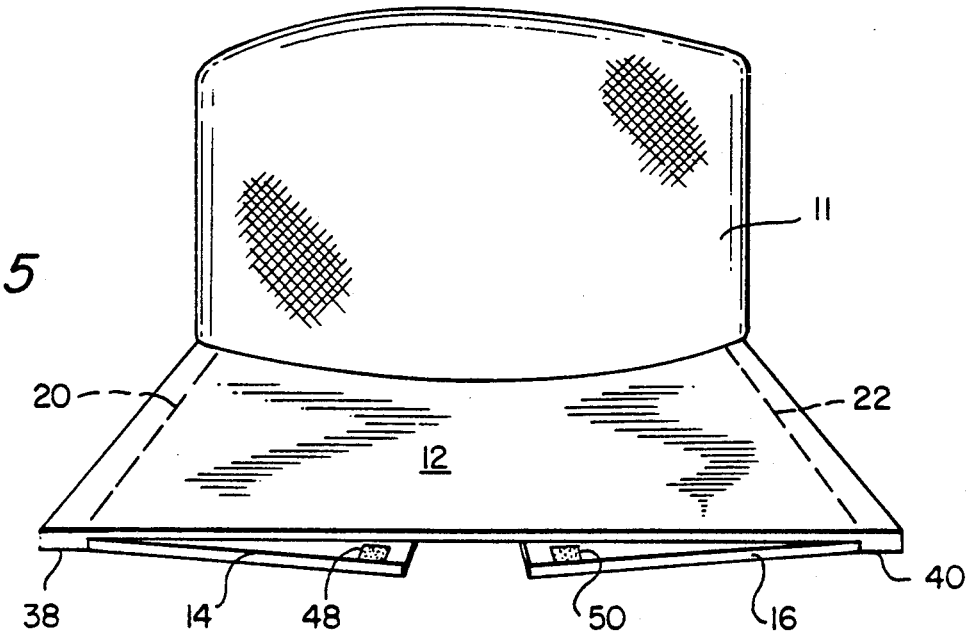

FOCUS VISION VISOR

BACKGROUND OF THE INVENTION

1. Field of the Invention

Headpieces or caps of the type having an extended horizontal visor. The visor is modified with a pair of blinders so as to occlude peripheral distraction and thus enable an athlete to focus his vision upon a specific target, as in golf, bowling, billiards and the other individually competitive games and sports.

2. Description of the Prior Art

| | |
|---|---|
| McNEILL | 1,356,542 |
| McGAFFEY | 1,486,098 |
| STERN | 1,557,375 |
| LINSTER | 2,717,385 |
| TROIANO | 4,321,708 |
| PHILLIPS | 4,541,125 |
| LAURANCE | 4,839,924 |
| OTSUKA et al. | 4,852,882 |

Earlier inventors have devised visors with folding blinders. However, none have provided the combination of a pair of blinders which are secured so as to be inset with the edge of the visor and may be stored during non-use in horizontal abutment with the underside of the visor.

SUMMARY OF THE INVENTION

According to the present invention, a focus vision visor is adapted for fitting to the crown of a headpiece or cap. The visor extends horizontally to define front, side and rear edges adapted for attachment to the crown of the cap. At least one blinder is pivotably secured at its top to a side edge of the visor, so as to depend vertically thereof and securement means are attached to the underside of the visor and the inside of the blinder, such that the blinder may be stored during non-use in horizontal abutment with the underside of the visor. The blinder is inset with respect to the side edges of the visor and is stitched or otherwise connected to the visor, so as to be biased inwardly and engage the cheek of the wearer.

DESCRIPTION OF THE DRAWINGS

FIG. 3 is a side elevation with the blinders in storage mode.

FIG. 4 is a side elevation of the focus vision visor attached to a golfer's-type headpiece.

FIG. 5 is a front elevation of a cap, showing the blinders secured to the underside of the visor by "Velcro" or the like attachment means.

In FIG. 1 baseball-type headpiece 10 is shown as having collapsible top cover 11, horizontally extending visor 12 with depending side blinders 14, 16 stitched as at 20, 22, so as to be inset with respect to the visor side edges 38, 40.

In FIG. 2, there is illustrated the interior 36 of headpiece 11 with crown 66 secured to the visor 12 by means of curvate stitches 30. Visor 12 may be stitched or otherwise secured inwardly both to crown 66 and interior 36 by means of overlay piece 60, illustrated in phantom. The blinder 16 inside 26 and blinder 14 inside 24 are in horizontal abutment with the underside of visor 12, such that the inner edges 32,34 may be deformed within the crown, as the headpiece is worn. Optional resilient ribs 62, 64 (illustrated in phantom line) may extend through the lower sides of the blinders as a reinforcement urging the blinders to abut the wearer's cheek, as illustrated in FIG. 1.

As illustrated in FIGS. 5 and 6, blinders 14, 16 may have Velcro attachments 48, 50 on their inner sides for securement to corresponding Velcro elements 52, 54 attached to the underside of visor 12.

As illustrated in FIG. 3, modified crown 42, may have adjustment features in the form of studs 44 engaging corresponding holes in the rear of the headpiece.

In FIG. 4, the golfer's headpiece 46 is shown with applicant's focus vision visor attached thereto.

In FIG. 7, side edges 56, 58 of visor 12 are shown in parallel abutment with the tops 38, 40 of blinders 14 and 16. Blinders 14 and 16 are stitched as at 20, 22 so as to have the inward bias illustrated in FIGS. 7 and 8.

Figure 7:
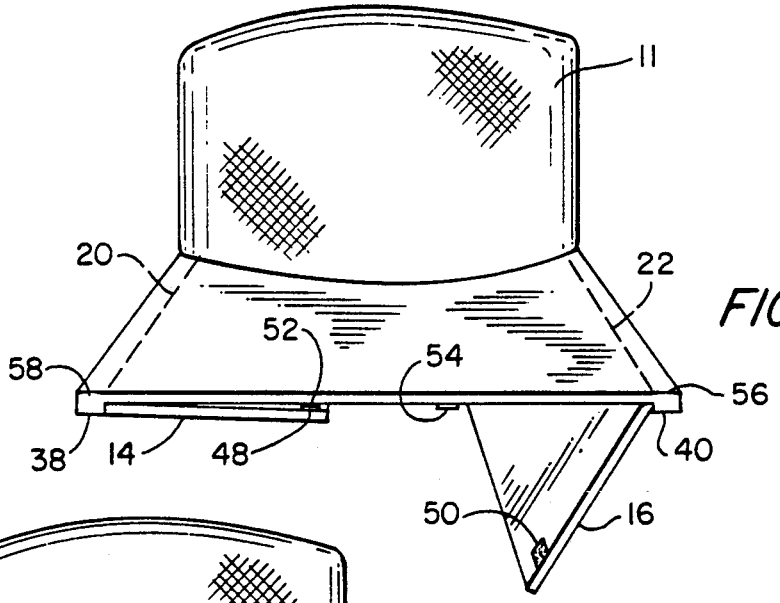
FIG. 7 is a front elevation, showing the left hand visor released for selective use.
Figure 8:
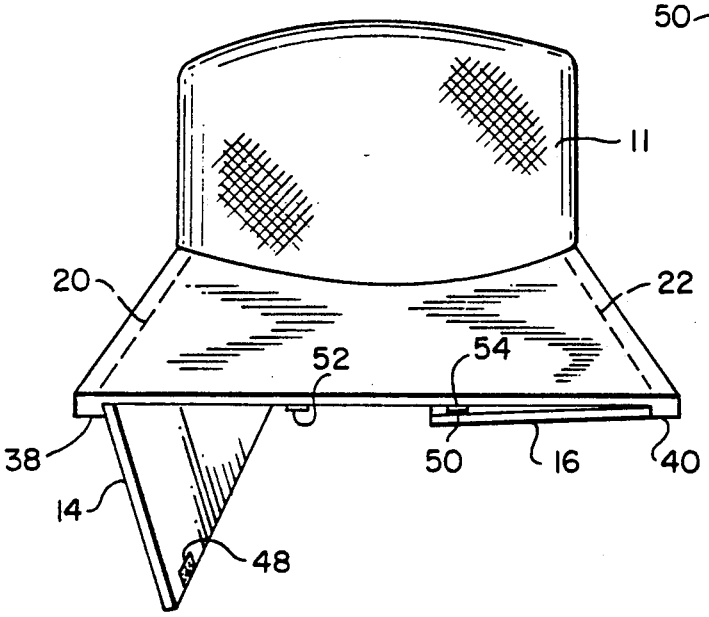
FIG. 8 is a front elevation showing the right hand visor released for selective use.

As will be apparent, the blinders may be stored in the non-use mode, as illustrated in FIGS. 3 and 4, or they may be selectively released to provide peripheral shielding on the right, left or both sides such as in golf, bowling, and billiards. The visor while being worn conventionally is constructed to provide the wearer options, as follows:

1. Protection from the normal sun rays, as in FIGS. 3 and 4.
2. Peripheral shielding on the left for the left eye, as in FIG. 7.
3. Peripheral shielding on the right for the right eye, as in FIG. 8.
4. Peripheral shielding of both eyes, as in FIGS. 1 and 5.

The wearer is thus afforded options ranging from the non-use or blinder storage mode to full peripheral shielding.

Figure 1:
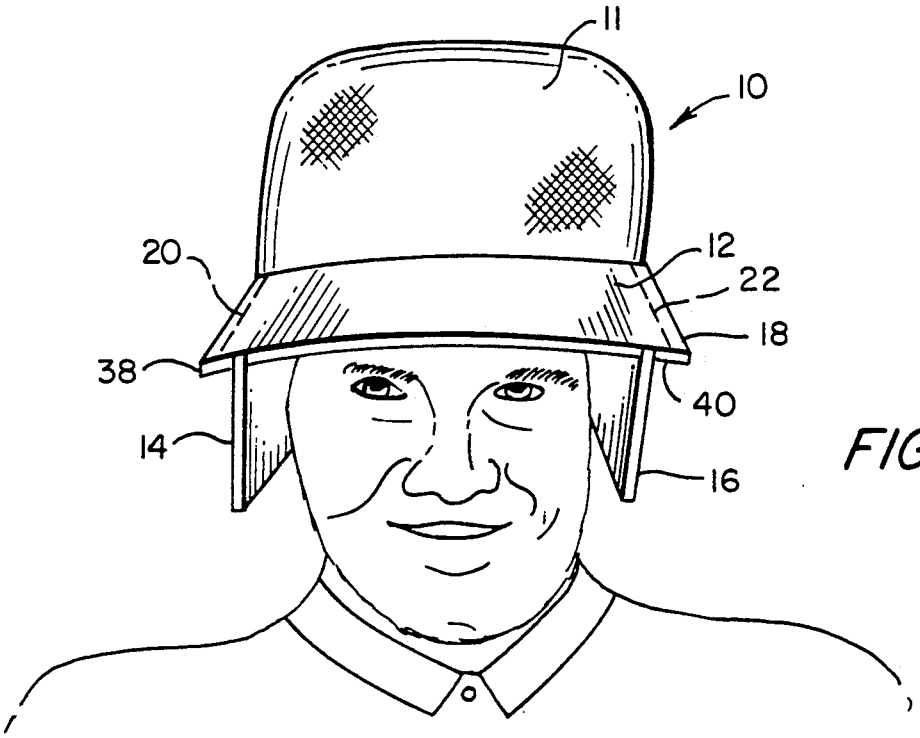
FIG. 1 is a perspective view of the focus vision visor, with both blinders in use.
Figure 2:
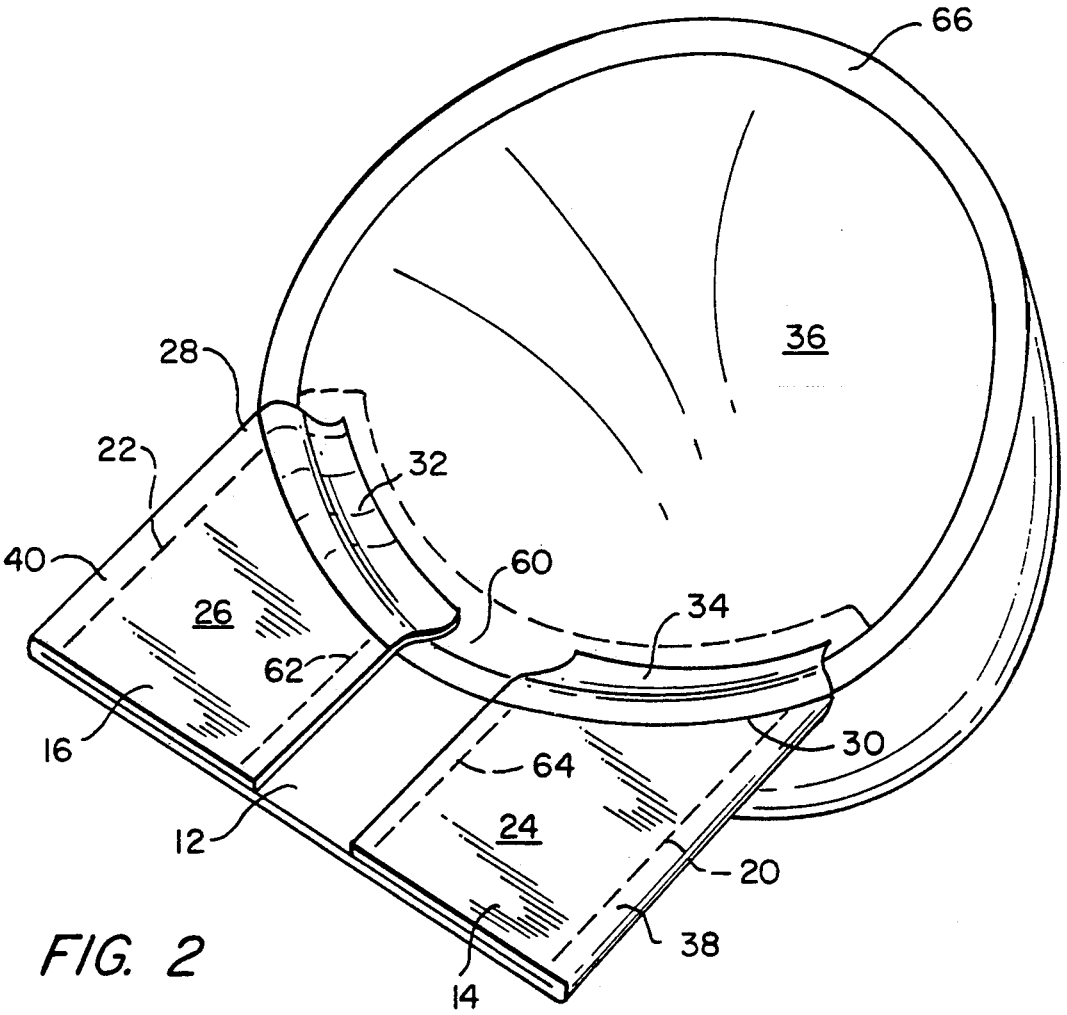
FIG. 2 is a perspective of the bottom of the cap with the blinders in the nonuse or storage mode in horizontal abutment with the inner side of the cap visor.
Figure 6:
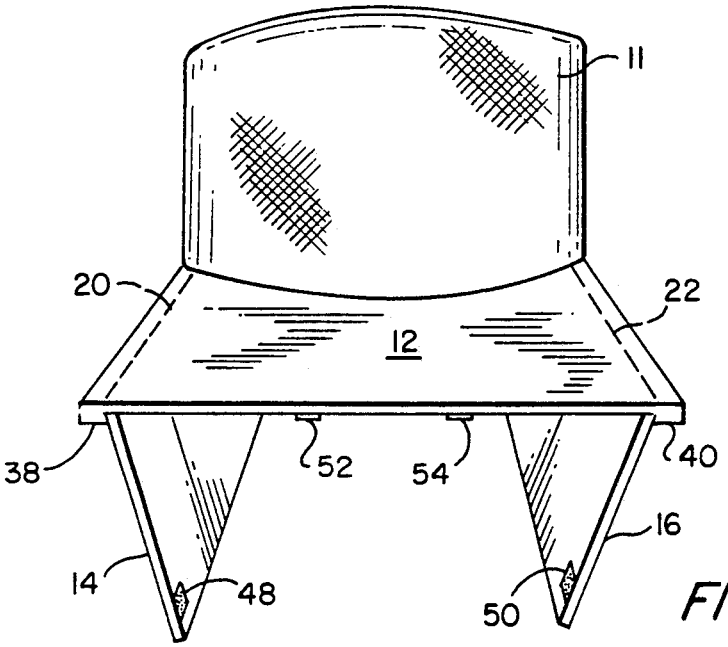
FIG. 6 is a front elevation, showing the inward bias of the depending blinders towards the cheek of the wearer.

In the mode illustrated in FIG. 1, the visor platform serves a normal sun-shielding function while blinders 14, 16 afford the wearer maximum peripheral shielding from the natural and man-made light sources, including total occlusion of peripheral distractions.

Manifestly, the blinders may be variously attached to the visor and variously configured without departing from the spirit and scope of invention.

I claim:

1. A focus vision visor of the type adapted for fitting to the crown of a headpiece comprising:

(a) a horizontally extending visor defining a front edge, side edges and a rear edge adapted for attachment to the crown;

(b) a pair of blinders secured to each side edge of said visor so as to depend vertically thereof, each blinder being made of resilient material so as to abut the human cheek and having an inside and an outside defined by top, bottom, rear and front, each said blinder being pivotably secured at its top so as to be inset with respect to the side edges of said visor such that the side edges of the said visor overhang said blinders, said blinders being stitched to the side edges of said visor so as to be biased inwardly, the inner edge is foldable within the crown and said blinders being conformed such that their inner edge is foldable within the inside of the crown; and (c) securement means attached to the underside of said visor and the in side of said blinder, such that each side blinder may be stored in horizontal abutment with the underside of said visor.

2. A focus vision visor as in claim 1, said visor being modified for attachment to a golf player's headpiece.

3. A focus vision visor as in claim 1, including a resilient rib supported in the lower edge of each said blinder.

* * * * *